US006663107B2

(12) United States Patent
Fisher et al.

(10) Patent No.: US 6,663,107 B2
(45) Date of Patent: Dec. 16, 2003

(54) CARD GAME

(76) Inventors: Anthony J. Fisher, 5335 E. Shea #2072, Phoenix, AZ (US) 85254; Daryle R. Simpson, 2516 N. 86th Pl., Scottsdale, AZ (US) 85257

( * ) Notice: Subject to any disclaimer, the term of this patent is extended or adjusted under 35 U.S.C. 154(b) by 0 days.

(21) Appl. No.: 10/103,357

(22) Filed: Mar. 21, 2002

(65) Prior Publication Data

US 2003/0178775 A1 Sep. 25, 2003

(51) Int. Cl.[7] ..... A63F 1/00
(52) U.S. Cl. ..... 273/292; 273/259; 273/298
(58) Field of Search ..... 273/292, 259, 273/298, 468

(56) References Cited

U.S. PATENT DOCUMENTS

| | | | | | |
|---|---|---|---|---|---|
| 1,056,770 | A | | 3/1913 | Barker | |
| 1,259,987 | A | * | 3/1918 | Huff et al. | 273/244.2 |
| 1,530,316 | A | * | 3/1925 | Hammons | 273/298 |
| D92,225 | S | * | 5/1934 | Acosso et al. | 106/235 |
| 2,088,492 | A | * | 7/1937 | Stowe | 273/298 |
| 2,788,213 | A | * | 4/1957 | Hull | 273/244.2 |
| 2,812,181 | A | * | 11/1957 | Richman | 273/244.2 |
| D194,791 | S | * | 3/1963 | Obst | 119/436 |
| 4,141,548 | A | * | 2/1979 | Everton | 463/4 |
| 4,429,877 | A | | 2/1984 | Coppock | |
| 4,496,148 | A | * | 1/1985 | Morstain et al. | 463/9 |
| 4,540,174 | A | | 9/1985 | Coppock | |
| 4,722,526 | A | | 2/1988 | Tovar et al. | |
| 4,822,043 | A | * | 4/1989 | Carter | 273/298 |
| 5,090,735 | A | * | 2/1992 | Meaney et al. | 283/67 |
| 5,145,173 | A | * | 9/1992 | Crowder | 273/298 |
| 5,407,204 | A | | 4/1995 | Meyer, III | |
| 5,522,590 | A | * | 6/1996 | Moran | 273/244.2 |
| 5,730,443 | A | | 3/1998 | Allen | |
| 5,762,337 | A | * | 6/1998 | Poisson | 273/244.2 |
| 5,884,914 | A | * | 3/1999 | Lilien | 273/244.1 |
| 6,012,721 | A | * | 1/2000 | Harnish | 273/298 |
| 6,015,345 | A | * | 1/2000 | Kail | 463/16 |
| 6,102,797 | A | * | 8/2000 | Kail | 463/16 |
| 6,209,872 | B1 | * | 4/2001 | Caswell | 273/244.2 |
| 6,293,868 | B1 | * | 9/2001 | Bernard | 463/42 |
| 6,338,486 | B1 | * | 1/2002 | Hutchens | 273/298 |
| 6,511,069 | B1 | * | 1/2003 | Nurse | 273/244.2 |

OTHER PUBLICATIONS

Internet printouts from the QB1 web site, www.qb1.com.

* cited by examiner

*Primary Examiner*—Benjamin H. Layno
*Assistant Examiner*—D Collins
(74) *Attorney, Agent, or Firm*—Elizabeth A. Campbell

(57) ABSTRACT

The present invention relates to a means and method for playing a card game while perceiving a sporting event, such as a baseball game. According to the present invention, each card game player is dealt a certain number of cards at the beginning of the card game and before a play in the sporting event being perceived. Before the play begins, each card game player selects and plays a card from the cards he has been dealt with the description of a result which the card game player thinks has the best chance of duplicating the result of the play in the sporting event being perceived. If the outcome of the play corresponds with the description of the result depicted on the card, the player is awarded points. After all card game players have played their cards, the play is completed, and points, if any, have been assessed, each card game player is dealt a new card before the next play.

26 Claims, 3 Drawing Sheets

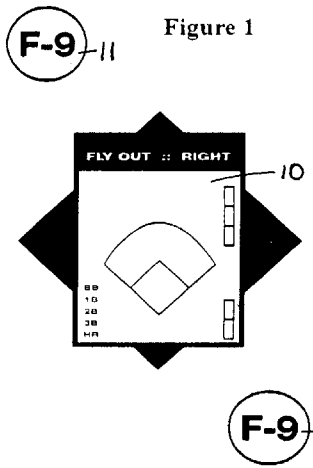
Figure 1
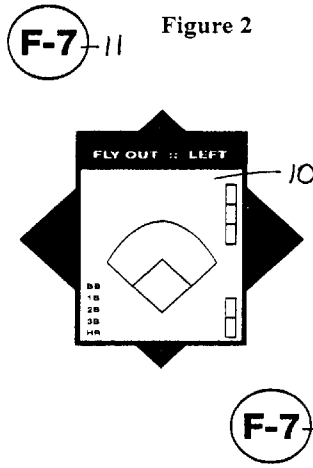
Figure 2
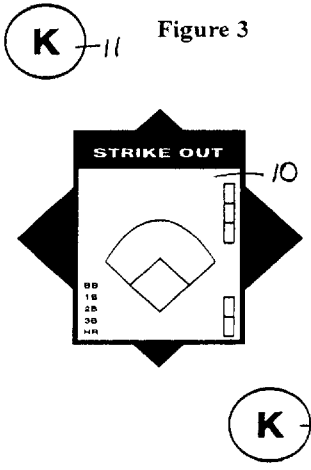
Figure 3
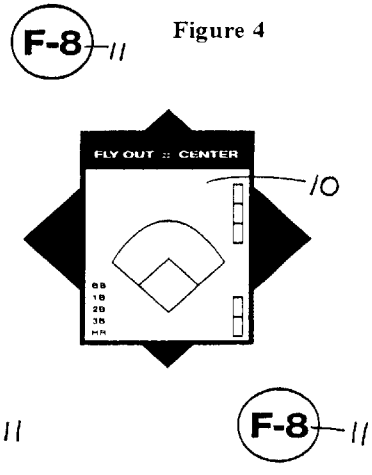
Figure 4
Figure 5
Figure 6
Figure 7
Figure 8

6-3
11
GROUND OUT :: SS
10
6-3
11

5-3
11
GROUND OUT :: 3B
10
5-3
11

IF
11
INFIELD FLY
10
IF
11

1-3
11
GROUND OUT :: P
10
1-3
11

1B
11
INFIELD HIT
10
1B
11

2B
11
DOUBLE
10
2B
11

3B
11
TRIPLE
10
3B
11

DP
11
DOUBLE PLAY
10
DP
11

CARD GAME

BACKGROUND OF THE INVENTION

Sporting events are a favorite pastime, and, as a consequence, various games inspired by sporting events have been considered. Once such game is disclosed in U.S. Pat. No. 1,530,316 to Hammons. The Hammons patent teaches a baseball card game which simulates an actual baseball game. The Hammons patent discloses a game which includes two groups of cards, namely, a scoring group and a defensive group, which are dealt indiscriminately to the players. The cards have designations of either defensive or offensive plays. Each player receives four cards. The players are divided into two teams: an at bat team, and a fielding team. Although both scoring and defensive cards are dealt to all players, the at bat team attempts to play scoring cards attempts to put men on base, and the fielding team attempts to play defensive cards to keep the at bat team's men off base or to get them out.

While some Patents, such as the Hammons Patent, teach games which simulate actual sporting events, other Patents disclose games which are to be played while watching an actual sporting event. U.S. Pat. No. 5,730,443 to Allen discloses a non-electronic game in which the players throw down a flag when they believe that a penalty has occurred in the sporting event being watched. Players receive points for correctly predicting the penalty the game referee identifies. Similarly, U.S. Pat. No. 4,722,526 to Tovar et al. also discloses a game played while watching a sporting event. The patent to Tovar et al. discloses a game in which the players activate a signaling device when they believe that an infraction of the rules has occurred in the sporting event being watched. Players receive points if the infraction they state is the same infraction as is called by the officials refereeing the sporting event.

U.S. Pat. Nos. 4,429,877 and 4,540,174 to Coppock disclose a game wherein the player is randomly assigned or randomly selects game plays. When the plays are to be randomly selected by the player, the possible game plays are covered so that the player does not decide which game play he is going to chose. To win, the play made in the sporting event must match the play randomly assigned to or randomly selected by the player.

U.S. Pat. No. 4,141,548 patent discloses an electronic game in which each player is provided with a selection panel having switches. The selection panel of each player is electronically connected to a control apparatus. The player watching a sporting event selects a switch which corresponds to his prediction of the play which will occur next in the sporting event. The player then makes a selection of "gain,""loss," or "zero" from a second set of switches. Predictions are made an prior to the time the play is run. Once predictions are made, a controller with the control unit locks in the predictions on the selector panels so that they cannot be changed. After the play is over, the controller punches in the actual executed play on the control panel as well as the outcome thereof, which information is electrically replayed to the selector panels. The scoring means on each panel is then adjusted accordingly.

There is a need for a card game that can be played in conjunction with perceiving a sporting event. Although the Pat. Nos. discussed above disclose various games related to sporting events, it is desirable to a have a card game wherein the card game players select and play a card from the cards each has been dealt which each player believes has the best chance of corresponding with the results of the next play in the sporting event being perceived.

SUMMARY OF THE INVENTION

The present invention relates to a means and method for playing a card game while perceiving a sporting event, such as a baseball game. The sporting event may be perceived either visually, such as by attending the game or watching it on television, or audibly, such as by radio. According to the card game of the present invention, each card of the game depicts an outcome of one play or at bat. In the game of baseball, an at bat occurs each time a player from the offensive team has an opportunity to hit the baseball. A single at bat begins when the pitcher on the defensive team throws the first pitch and continues until the hitter from the offensive team either reaches base or makes an out.

According to the present invention, each card game player is dealt a certain number of cards at the beginning oft he card game and before a play in the sporting event being perceived. Before the play begins, each card game player selects and plays a card from the cards he has been dealt with the description of a result which the card game player thinks has the best chance of duplicating the result of the play in the sporting event being perceived. If the outcome of the play corresponds with the description of the result depicted on the card, the player is awarded points. After all card game players have played their cards, the play is completed, and points, if any, have been assessed, each card game player is dealt a new card before the next play.

BRIEF DESCRIPTION OF THE DRAWINGS

FIGS. 1 through 23 are representations of playing cards for use in playing the preferred emobiment of the game of the present invention.

FIG. 1 is a depiction of a playing card of the present invention depicting the at bat result of a fly out to right field.

FIG. 2 is a depiction of a playing card of the present invention depicting the at bat result of a fly out to left field.

FIG. 3 is a depiction of a playing card of the present invention depicting the at bat result of a strike out.

FIG. 4 is a depiction of a playing card of the present invention depicting the at bat result of a fly out to center field.

FIG. 5 is a depiction of a playing card of the present invention depicting the at bat result of a sacrifice.

FIG. 6 is a depiction of a playing card of the present invention depicting the at bat result of a walk or a base on balls.

FIG. 7 is depiction of a playing card of the present invention depicting the at bat result of a ground out to first base.

FIG. 8 is a depiction of a playing card of the present invention depicting the at bat result of a ground out to second base.

FIG. 9 is a depiction of a playing card of the present invention depicting the at bat result of a ground out to the short stop.

FIG. 10 is a depiction of a playing card of the present invention depicting the at bat result of a ground out to third base.

FIG. 11 is a depiction of a playing card of the present invention depicting the at bat result of an infield fly.

FIG. 12 is a depiction of a playing card of the present invention depicting the at bat result of a ground out to the pitcher.

FIG. 13 is a depiction of a playing card of the present invention depicting the at bat result of an infield hit.

FIG. 14 is a depiction of a playing card of the present invention depicting the at bat result of a double.

FIG. 15 is a depiction of a playing card of the present invention depicting the at bat result of a triple.

FIG. 16 is a depiction of a playing card of the present invention depicting the at bat result of a double play.

FIG. 17 is a depiction of a playing card of the present invention depicting the at bat result of an error.

FIG. 18 is a depiction of a playing card of the present invention depicting the at bat result of a home run.

FIG. 19 is a depiction of a playing card of the present invention depicting the at bat result of a single to center.

FIG. 20 is a depiction of a playing card of the present invention depicting the at bat result of a single to right.

FIG. 21 is a depiction of a playing card of the present invention depicting the at bat result of a single to left.

FIG. 22 is a depiction of a playing card of the present invention depicting the at bat result of a hit by pitch.

FIG. 23 is a depiction of a playing card of the present invention depicting the at bat result of a ground out to catcher.

DETAILED DESCRIPTION OF THE PREFERRED EMBODIMENTS

The following is a description of the forms of the invention which are presently preferred; it being understood, however, that this invention is not limited to the precise arrangement and instrumentalities shown. Further, although the present invention in its preferred embodiment is applied to the game of baseball, it is understood that the present invention may also be applied to other sporting events, with appropriate alterations of the playing cards.

Figures 9, 10, 11, 12, 13, 14, 15, 16:
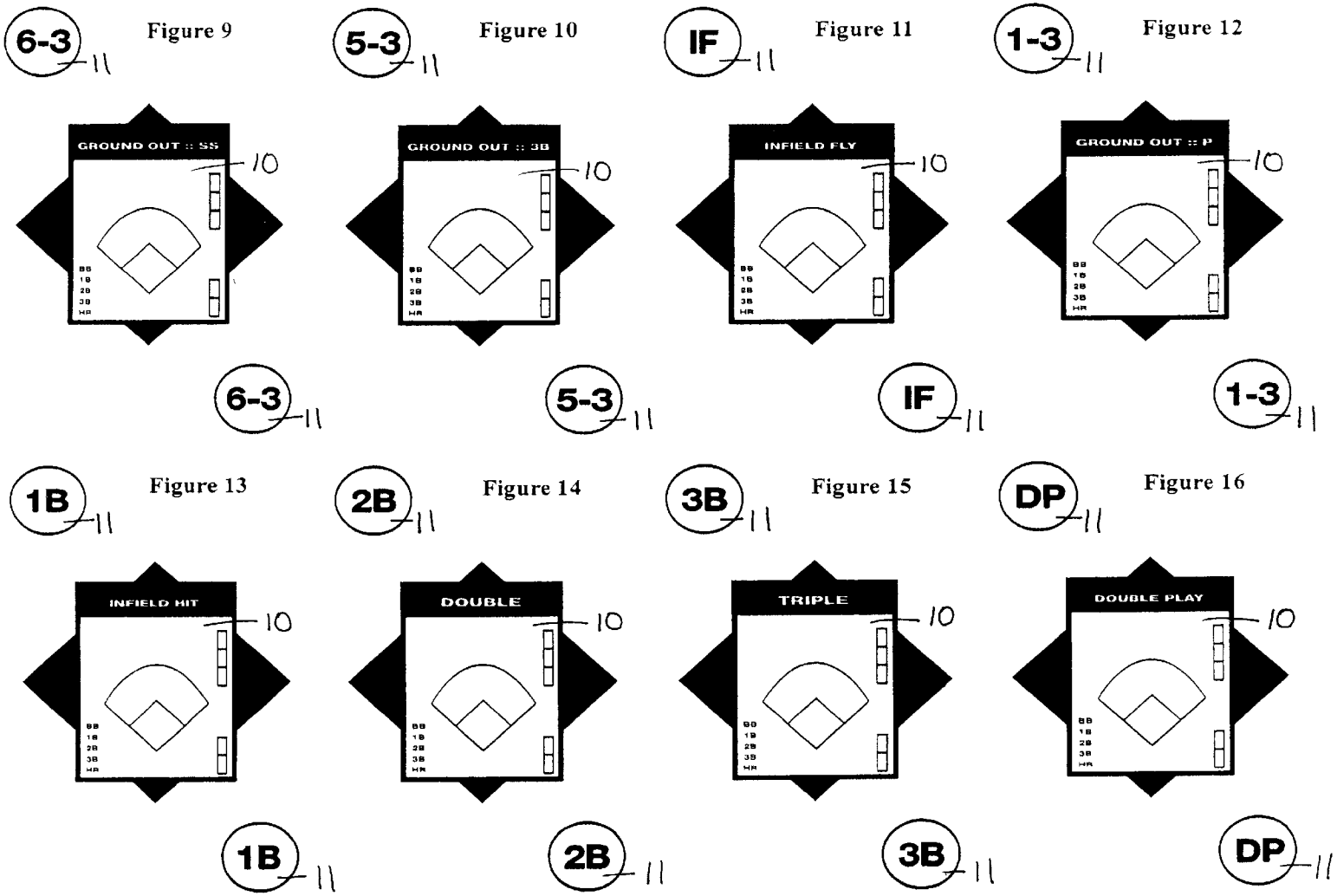
Figures 17, 18, 19, 20, 21, 22, 23:
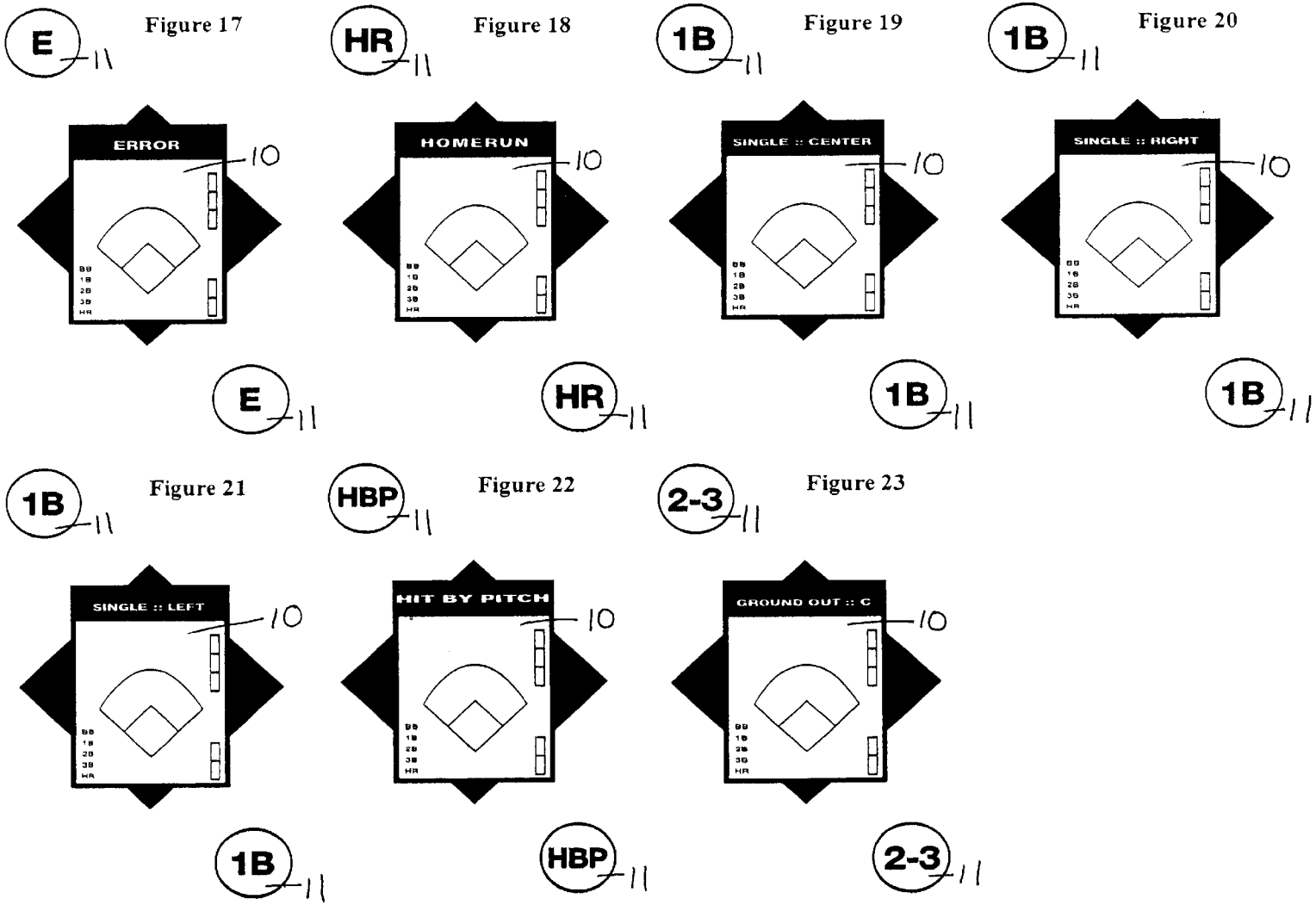

FIGS. 1 through 23 show playing cards according to the card game of the present invention. As shown in FIGS. 1 through 23, the numeral 10 indicates generally a depiction of a possible result of a single at bat, it being understood that the depiction of the possible result of a single at bat may be represented in graphic or word form. According to the preferred embodiment of the present invention, each of the playing cards depict a possible result of an at bat in a baseball game. Only one possible result of an at bat is depicted per card. An at bat occurs each time a player from the offensive team has an opportunity to hit the baseball. An at bat begins when the pitcher on the defensive team throws the first pitch and continues until the hitter from the offensive team either reaches base or makes an out. The number 11 indicates generally the commonly accepted symbolic designation of a possible result of a single at bat. The commonly accepted symbolic designation may be used in addition to or instead of other designation of the possible result of a single at bat on a playing card.

The card game of the present invention is played while perceiving a baseball game. The baseball game may be perceived either visually, such as by attending the game or watching it on television, or audibly, such as by radio. The baseball game may be either live or recorded, but the card game players should not know the outcome of the game, and, more particularly, the card game players should not be aware of the outcome of any at bat during the baseball game being watched or listened to.

In the preferred embodiment of the invention, playing cards have the following depictions: fly out to right field, fly out to left field; strike out; fly out to center field; sacrifice; walk; ground out to first base; ground out to second base; ground out to short stop; ground out to third base; infield fly; ground out to pitcher; infield hit; double; triple; double play; error; home run; single to right; single to center; single to left; hit by pitch; and ground out to catcher. It is understood that playing cards containing fewer designations or additional designations may be used to play the card game of the present invention. Each game card depicts one designation of a possible result of an at bat.

In the preferred embodiment of the invention, a set of the following fifty-two playing cards are used: two cards designating a fly out to right field; two cards designating a fly out to left field; six cards designating a strike out; two cards designating a fly out to center field; three cards designating a walk; two cards designating a ground out to first base; three cards designating a ground out to second base; three cards designating a ground out to the short stop; two cards designating a ground out to third base; one card designating an infield fly; one card designating a ground out to the pitcher; one card designating an infield hit; three cards designating a double; one card designating triple; two cards designating a double play; one card designating an error; four cards designating a home run; three cards designating a single to center; three cards designating a single to right; three cards designating a single to left; two cards designating a ground out to catcher; one card designating a sacrifice; and once card designating a hit by pitch.

According to the present invention, each card game player is dealt a certain number of cards for the first hand of the card game. The first hand is dealt before an at bat. In the preferred embodiment of the invention where the fifty-two playing cards described above are used, it is further preferred that the card game of the present invention be played by between two and four players. If it is desired that more than four card game players play the card game of the present invention, it is preferred that a second set of the fifty-two playing cards described above be used together with a first set of the playing cards described above.

Also according to the preferred embodiment of the invention, each card game player is dealt seven cards at the beginning of the first hand. Before the at bat begins, each card game player selects and plays a card from the cards he has been dealt with the result designation 10 which that card game player thinks has the best chance of duplicating the result of the at bat in the baseball game being watched or listened to.

The at bat in the baseball game then begins. Once the at bat in the baseball game has been completed, the result of the at bat in the baseball game is compared against the result designations of the cards played by the card game players. If the outcome of the at bat in the baseball game matches a designated result on a card played by a card game player, the player who played the card with the designated result which matched the result of the at bat in the baseball game is awarded a point or points. Optionally, additional points may be awarded to a card game player playing the card with the designated result matching the result of the at bat in the baseball game where the result of the at bat in the baseball game is a home run or a triple. If no card game player plays a card where the designated result on the game card matches the result of the at bat in the baseball game being watched or listened to, no points are awarded to any player for that hand.

After all card game players have played their cards, the at bat is completed, and points, if any, have been assessed, the game cards which have been played by the player are removed. Each card game player is then dealt a new game card, and each card game player must select and play the card in his hand with the designated result which the card game player believes will match the result of the next at bat in the baseball game. The card game continues until all game card have been dealt and played or until the baseball game being watched or listened to is over. If the baseball game being watched or listened to is not yet over, and all game cards have been dealt and played, the game cards which were removed after they were played may be collected by the dealer, shuffled, and the card game can then continue until the end of the baseball game being watch or listened to. Points may be tallied either after all game cards have been dealt and played once or after the conclusion of the baseball game begin watched. The winner is the card game player with the most points, which will be the card game player who most often played the game card with the designated result matching the result of the at bat in the baseball game begin watched or listened to.

What is claimed is:

1. A method for playing a card game comprising:

a. Perceiving a sporting event;

b. Before a play in said sporting event being perceived, dealing at least one card to each player of a group of at least one card game players, each of said cards having a depiction of a possible result of a possible play in said sporting event;

c. Before said play in said sporting event, each of said players selecting one card from said cards dealt to each of said players, said players each selecting the card each of said players thinks will have the best chance of corresponding with the results of said play in said sporting event;

d. Before said play in said sporting event, each of said players playing the card each selected;

e. Perceiving the results of said play in said sporting event;

f. Comparing the results of said play in said sporting event with said depictions on said cards played;

g. Determining if the results of said play correspond with any of said depictions on said cards played;

h. Assigning at least one point to each player where the designation of the card played by that player corresponds with said result of said play in said sporting event;

i. Assigning no points to each player where the designation of the card played by that player does not correspond with said result of said play in said sporting event;

j. Continuing said card game until a predetermined ending point;

k. After said predetermined ending point, adding the points assigned to each of said players; and l. Determining the winner to be the player with the highest number of points.

2. The method of claim 1 wherein said group of card game players includes between 2 and 4 players.

3. The method of claim 2 wherein seven cards are dealt to each of said card game players.

4. A method for playing a card game comprising:

a. Perceiving a baseball game;

b. Before an at bat in said baseball game being perceived, dealing at least one card to each player of a group of at least one card game players, each of said cards having a depiction of a possible result of an at bat;

c. Before said at bat, each of said players selecting one card from said cards dealt to each player, said players each selecting the card each of said players thinks will have the best chance of corresponding with the results of said at bat;

d. Before said at bat, each of said players playing the card each selected;

e. Perceiving the results of the at bat in the baseball game;

f. Comparing the results of said at bat in said baseball game with said depictions on said cards played;

g. Determining if the results of said at bat correspond with any of said depictions on said cards played;

h. Assigning at least one point to each player where the designation of the card played by that player corresponds with said result of said at bat;

i. Assigning no points to each player where the designation of the card played by that player does not correspond with said result of said at bat;

j. Continuing said card game until a predetermined ending point;

k. After said predetermined ending point adding the points assigned to each of said players; and l. Determining the winner to be the player with the highest number of points.

5. The method of claim 4 wherein said cards have the following depictions: fly out to right field, fly out to left field; strike out; fly out to center field; sacrifice; walk; ground out to first base; ground out to second base; ground out to short stop; ground out to third base; infield fly; ground out to pitcher; infield hit; double; triple; double play; error; home run; single to right; single to center; single to left; hit by pitch; and ground out to catcher.

6. The method of claim 5 wherein said cards have the following depictions and wherein said deck contains the following number of cards: two cards designating a fly out to right field; two cards designating a fly out to left field; six cards designating a strike out; two cards designating a fly out to center field; three cards designating a walk; two cards designating a ground out to first base; three cards designating a ground out to second base; three cards designating a ground out to the short stop; two cards designating a ground out to third base; one card designating an infield fly; one card designating a ground out to the pitcher; one card designating an infield hit; three cards designating a double; one card designating triple; two cards designating a double play; one card designating an error; four cards designating a home run; three cards designating a single to center; three cards designating a single to right; three cards designating a single to left; two cards designating a ground out to catcher; one card designating a sacrifice; and one card designating a hit by pitch.

7. The method of claim 6 wherein said group of card game players includes between 2 and 4 players.

8. The method of claim 4 wherein seven cards are dealt to each of said card game players.

9. The method of claim 4 wherein additional points are assigned to said players if the designation of the card played by that player corresponds with said result of said at bat, and the result of said at bat is a home run or a triple.

10. A card game to be played while perceiving a sporting event, said card game comprising:

a. A means for perceiving a sporting event;

b. A set of game cards, each of said cards being provided with a depiction of a possible result of a play in the sporting event;

c. A means for distributing at least one card to each player in a group of card game players before a play in said sporting event, said group including at least one player, each player of said group selecting and playing a card from said cards distributed to that player which that player thinks will have the best chance of corresponding with the results of said play in said sporting event;

d. A means for determining the results of said play in said sporting event being perceived;

e. A means for determining whether said depictions on said cards selected and played by said players correspond with said results of said play in said sporting event, at least one point being assigned to each player where the depiction on the card selected and played by that player corresponds to the results of said play in said sporting event, and no points being assigned to each player where the designation of the card played by that player does not correspond with the result of said play in said sporting event; and f. A means for adding the points assigned to each of said players at a predetermined ending point, with the player with the most number of points being the winner.

11. The card game of claim 10 wherein said group of card game players includes between 2 and 4 players.

12. The card game of claim 10 wherein seven cards are dealt to each of said card game players.

13. A card game to be played while perceiving a baseball game, said card game comprising:

a. A means for perceiving a baseball game;

b. A set of game cards, each of said cards being provided with a depiction of a possible result of an at bat;

c. A means for distributing at least one card to each player in a group of card game players before an at bat, said group including at least one player, each player of said group selecting and playing a card from said cards distributed to that player which that player thinks will have the best chance of corresponding with the results of said at bat;

d. A means for determining the results of said at bat in said baseball game being perceived;

e. A means for determining whether said depictions on said cards selected and played by said players correspond with said results of said at bat, at least one point being assigned to each player where the depiction on the card selected and played by that player corresponds to the results of the at bat, and no points being assigned to each player where the designation of the card played by that player does not correspond with said result of said at bat; and f. A means for adding the points assigned to each of said players at a predetermined ending point, with the player with the most number of points being the winner.

14. The card game of claim 13 wherein said cards have the following depictions: fly out to right field, fly out to left field; strike out; fly out to center field; sacrifice; walk; ground out to first base; ground out to second base; ground out to short stop; ground out to third base; infield fly; ground out[]to pitcher; infield hit; double; triple; double play; error; home run; single to right; single to left; single to center; ground out to catcher; and hit by pitch.

15. The card game of claim 14 wherein said cards have the following depictions and wherein said deck contains the following number of cards: two cards designating a fly out to right field; two cards designating a fly out to left field; six cards designating a strike out; two cards designating a fly out to center field; three cards designating a walk; two cards designating a ground out to first base; three cards designating a ground out to second base; three cards designating a ground out to the short stop; two cards designating a ground out to third base; one card designating an infield fly; one card designating a ground out to the pitcher; one card designating an infield hit; three cards designating a double; one card designating triple; two cards designating a double play; one card designating an error; four cards designating a home run; three cards designating a single to center; three cards designating a single to right; three cards designating a single to left; two cards designating a ground out to the catcher; one card designating a sacrifice; and one card designating a hit by pitch.

16. The card game of claim 15 wherein said group of card game players includes between 2 and 4 players.

17. The card game of claim 15 wherein seven cards are dealt to each of said card game players.

18. The card game of claim 13 wherein additional points are assigned to said players if the designation of the card played by that player corresponds with said result of said at bat, and the result of said at bat is a home run or a triple.

19. The method of claim 1 wherein said predetermined ending point is occurs when all of said game cards have been dealt and played.

20. The method of claim 1 wherein said predetermined ending point occurs when said sporting event being perceived is over.

21. The method of claim 4 wherein said predetermined ending point is occurs when all of said game cards have been dealt and played.

22. The method of claim 4 wherein said predetermined ending point occurs when said baseball game being perceived is over.

23. The card game of claim 10 wherein said predetermined ending point is occurs when all of said game cards have been dealt and played.

24. The card game of claim 10 wherein said predetermined ending point occurs when said sporting event being perceived is over.

25. The card game of claim 13 wherein said predetermined ending point is occurs when all of said game cards have been dealt and played.

26. The card game of claim 13 wherein said predetermined ending point occurs when said baseball game being perceived is over.

* * * * *

UNITED STATES PATENT AND TRADEMARK OFFICE

CERTIFICATE OF CORRECTION

PATENT NO. : 6,663,107 B2 
DATED : December 16, 2003
INVENTOR(S) : Anthony J. Fisher and Daryle R. Simpson It is certified that error appears in the above-identified patent and that said Letters Patent is hereby corrected as shown below:

Column 1,
Line 7, “Once such game” should read -- One such game --.

Column 2,
Line 18, “the beginning oft he card game” should read -- the beginning of the card game --.

Column 4,
Line 28, “once card designating a hit by pitch” should read -- one card designating a hit by pitch --.

Column 5,
Line 20, “the baseball game begin watched” should read -- the baseball game being watched --.

Column 8,
Lines 33, 39, 45 and 51, “is occurs” should read -- occurs --.

Signed and Sealed this

Third Day of February, 2004

JON W. DUDAS
*Acting Director of the United States Patent and Trademark Office*